US011988405B2

(12) United States Patent
Naber

(10) Patent No.: US 11,988,405 B2
(45) Date of Patent: May 21, 2024

(54) AIR DUCT AND AN ASSEMBLY FOR A FUME EXTRACTION HOOD

(71) Applicant: Naber Holding Gmbh & Co., Nordhorn (DE)

(72) Inventor: Hans-Joachim Naber, Nordhorn (DE)

(73) Assignee: Naber Holding Gmbh & Co. (DE)

( * ) Notice: Subject to any disclaimer, the term of this patent is extended or adjusted under 35 U.S.C. 154(b) by 21 days.

(21) Appl. No.: 17/749,553

(22) Filed: May 20, 2022

(65) Prior Publication Data

US 2022/0373215 A1 Nov. 24, 2022

(30) Foreign Application Priority Data

May 21, 2021 (DE) ..... 102021113247.9

(51) Int. Cl.
*F24F 13/02* (2006.01)
*F24C 15/20* (2006.01)

(52) U.S. Cl.
CPC ..... *F24F 13/0245* (2013.01); *F24C 15/20* (2013.01); *F24F 2221/36* (2013.01)

(58) Field of Classification Search
CPC .... F24F 13/0245; F24F 2221/36; F24C 15/20
USPC ..... 138/108
See application file for complete search history.

(56) References Cited

U.S. PATENT DOCUMENTS 2,164,394 A * 7/1939 Faber ..... F24F 13/02 138/116
4,249,578 A * 2/1981 Freeman ..... F16L 9/003 138/172
5,115,957 A * 5/1992 Smith ..... F24F 13/0254 29/33 F
6,116,833 A * 9/2000 Ellis ..... F24F 13/02 411/389
6,901,969 B2 * 6/2005 Siiter ..... F24F 13/02 138/172
8,844,578 B2 * 9/2014 Pinkalla ..... F16L 55/00 138/108
9,790,836 B2 * 10/2017 Latham ..... F01N 1/04
10,976,070 B1 * 4/2021 Albers ..... F24F 13/0263
2013/0074974 A1 * 3/2013 Murchie ..... F24F 13/0245 138/172
2016/0102786 A1 * 4/2016 Iwasaki ..... B60H 1/00564 181/224
2016/0131389 A1 * 5/2016 Lanciaux ..... F24F 13/0254 138/172
2019/0316805 A1 * 10/2019 Bruckbauer ..... F24F 13/02
2020/0326094 A1 10/2020 Lanciaux

FOREIGN PATENT DOCUMENTS

DE 202017105556 U1 9/2017
DE 102017104772 A1 9/2018
DE 102017221725 A1 6/2019
JP 2004308111 A 11/2004
(Continued)

*Primary Examiner* — David R Deal

(74) *Attorney, Agent, or Firm* — Harness, Dickey & Pierce, P.L.C.

(57) ABSTRACT

An air duct which extends substantially in a longitudinal direction (X), having a duct wall which encloses a flow cross section and has, on its inner side, at least one fastening means for fastening at least one functional element, which can be accommodated in the air duct, in a variable position in the longitudinal direction (X) of the duct.

14 Claims, 8 Drawing Sheets

(56) References Cited

FOREIGN PATENT DOCUMENTS

| | | | |
|---|---|---|---|
| JP | 2006170315 | A | 6/2006 |
| KR | 200440863 | Y1 | 7/2008 |
| WO | 2015183614 | A2 | 12/2015 |

* cited by examiner

AIR DUCT AND AN ASSEMBLY FOR A FUME EXTRACTION HOOD

CROSS-REFERENCE TO RELATED APPLICATIONS

This application claims the benefit and priority of German Application No. 10 2021 113 247.9 filed May 21, 2021. The entire disclosure of the above application is incorporated herein by reference.

BACKGROUND OF THE INVENTION

Technical Field

The invention relates to an air duct and an assembly for a fume extraction hood, wherein the duct extends substantially in a longitudinal direction, with a duct wall which encloses a flow cross-section.

Discussion

Various types of air ducts for ventilating and exhausting buildings are known from the prior art. The task of an air duct is, for example, to remove the vapors produced when working in kitchens, especially when heating food and liquids, from the area of the kitchen to keep the working area free of odors and condensate.

Against the background of increasing environmental awareness and growing competitive pressure in a globalized economy, the aim of resource-saving production of air ducts is, on the one hand, to reduce the amount of material used and, on the other, to design the air ducts for the widest possible range of applications. An air duct is known, for example, from DE 10 2017 104 772 A1.

However, the air ducts known from the prior art have the disadvantage that individual fastening means must be provided in each case for additional functional elements to be accommodated in the air duct. Furthermore, depending on the duct element length, additional center support may be necessary, but this can vary between different installation situations.

SUMMARY OF THE INVENTION

It is therefore an aspect of the invention to provide an air duct in which different functional elements can be accommodated in a particularly simple manner.

Accordingly, an air duct is proposed which extends essentially in a longitudinal direction, with a duct wall which encloses a flow cross section and has on its inside a fastening means for variably positionable fastening in the longitudinal direction of the duct of at least one functional element which can be accommodated in the air duct. The air duct can be designed in particular as a flat duct. The flat duct can have a transverse dimension which is larger than a height dimension of the flat duct. As a result, the duct wall enclosing the flat duct may have a total of four wall sections, of which the wall sections extending in the transverse direction are parallel to one another and the wall sections extending in the vertical direction are parallel to one another. The wall sections may each merge into each other via rounded corners. The air duct may alternatively be designed as a round duct. The inner side of the duct wall faces the flow cross section in particular. The functional element may be an element that technically interacts with the air duct. The functional element may further be an element extending the technical function of the air duct. For example, a support web, cable duct or sound damping element or a combination thereof may be a receivable functional element. The air duct may further comprise two oppositely arranged fastening means. This allows a functional element accommodated in the duct to be fixed to opposite inner sides of the duct. In particular, the opposing fastening means can be arranged in alignment with one another.

It may be provided that the duct wall has a wall thickness that varies over its course. For example, in the flat duct, the wall thickness in the rounded corners may be less than in the straight wall sections. It may also be provided that the wall thickness in the straight wall sections increases gradually towards the center in each case. In the flat duct design, it may further be provided that the maximum thickness of the wall sections extending in the transverse direction is greater than the maximum thickness of the wall sections extending in the vertical direction. For example, the wall thickness in the rounded corners may be between 0.8-1.6 mm, preferably between 1.0-1.4 mm, particularly preferably 1.2 mm. The maximum wall thickness of the wall sections extending in the height direction can be, for example, between 1.0-1.5 mm, preferably between 1.2-1.3 mm, particularly preferably 1.25 mm. The maximum wall thickness of the wall sections running in the transverse direction can be, for example, between 1.5-2.1 mm, preferably between 1.7-1.9 mm, particularly preferably 1.8 mm. Starting from the point of maximum wall thickness in the center of the wall sections running in the transverse direction, the corresponding wall sections on the outside of the flat duct can each extend in the direction of the corners with an inclination of between 0.2-0.6°, preferably between 0.3-0.5°, particularly preferably 0.4°. The height extension of the flat duct can be, for example, 80-92 mm, preferably 84-88, particularly preferably 86.6 mm. The transverse extent of the flat duct can be, for example, 200-240 mm, preferably 210-230 mm, particularly preferably 219.6 mm. The inner radius of the rounded corners may be, for example, 15-25 mm, preferably 18-22 mm, particularly preferably 20 mm.

The air duct can also have a riblet structure on its inside. Particularly advantageously, these can reduce frictional resistance on surfaces subject to turbulent overflow. The riblets can be designed as fine ribs with sharp tips. It may be provided that the longitudinal axes of the riblets or ribs are aligned in the direction of flow.

It may also be provided that the air duct has stiffening ribs running in the longitudinal direction on its outer side. The distance between the stiffening ribs can be smaller in the area of the rounded corners than in the area of the straight wall sections. The distance between the stiffening ribs can decrease gradually towards the center of the straight wall sections. For example, the maximum spacing of the stiffening ribs on the transversely aligned wall sections of the flat duct can be between 5-15 mm, preferably between 8-12 mm, particularly preferably 10 mm. Furthermore, the maximum spacing of the stiffening ribs on the wall sections of the flat duct aligned in the height direction can be between 3-7 mm, preferably between 4-6 mm, particularly preferably 5 mm.

In the design as a flat duct with an essentially rectangular flow cross section, the fastening means can preferably be arranged on the inside of one of the longer wall sections, in particular the transverse walls. When using the fastening means for fastening a support web, the flat duct can be supported particularly advantageously at its structurally weakest point, in which the support web is supported on the opposite wall.

The fastening means can be designed to prevent movement of the functional element from the duct wall section comprising the fastening means in the direction of the duct interior. This can prevent slipping or displacement of the functional element along the height axis, in particular in the direction of the duct center or the opposite wall, of the air duct. For this purpose, the fastening means can have a holding device which can be gripped behind by a functional element inserted into the air duct.

The fastening means can also be designed to prevent movement of the functional element in a transverse direction of the duct wall section comprising the fastening means. This can prevent slippage or displacement of the functional element along the transverse axis of the air duct, in particular along the duct wall section comprising the fastening means. For this purpose, the fastening means can have a holding device which laterally supports a functional element inserted into the air duct. In particular, the fastening means can have a holding device that fixes a functional element inserted into the air duct in the transverse direction from both sides.

Furthermore, the fastening means can be designed to prevent twisting of the functional element about an axis of rotation perpendicular to the plane of the duct wall section comprising the fastening means. Thus, twisting of the functional element in or parallel to the plane of the duct wall section comprising the fastening means can be prevented. For this purpose, the fastening means can have a holding device which supports a functional element inserted into the air duct in the transverse direction from both sides, the support points being offset from one another in the longitudinal direction of the duct.

In addition, the fastening means can be designed to prevent twisting of the functional element about an axis of rotation perpendicular to the flow cross section. In this way, twisting of the functional element parallel to the duct wall can be prevented. For this purpose, the fastening means can have a holding device which can be gripped behind by a functional element inserted into the air duct at at least two support points spaced apart from one another in the transverse direction.

The fastening means can be designed to prevent twisting of the functional element about an axis of rotation perpendicular to the longitudinal duct section. This can prevent twisting of the functional element about the transverse axis. For this purpose, the fastening means can have a holding device which can be gripped behind by a functional element inserted into the air duct at least two support points spaced apart from one another in the longitudinal direction.

Furthermore, the fastening means can have at least one linear rail extending at least in sections in the longitudinal direction of the duct. In particular, the linear rail can be arranged centrally on the duct wall comprising it. The linear rail can extend over the entire length of the duct.

In addition, the fastening means can have at least two undercut latching sections, whereby the functional element can be pushed onto the fastening means in the longitudinal direction of the duct. For example, the at least one linear rail can have a longitudinal groove in which the two latching sections are designed to face one another in an undercut manner. Alternatively, the at least one linear rail can have two latching sections facing away from each other in the transverse direction on its outer sides.

The fastening means can comprise two parallel linear rails, each of which has an undercut latching section. For simplified threading of the functional element, the two linear rails can have a widening at the ends of the duct piece lying in the longitudinal direction or can be slightly spaced apart. In a corresponding manner, the latching sections can also be widened at the widened ends.

The at least one linear rail may have a first section extending substantially perpendicularly away from the duct wall and an adjoining second section extending substantially parallel to the duct wall.

The undercut latching sections can point towards each other. Alternatively, the undercut latching sections can point away from each other.

The fastening means can be formed integrally with the duct wall or molded onto it. The duct can be produced by extrusion, for example.

It may be envisaged that the air duct is designed as a flat duct and has a varying wall thickness, wherein the wall thickness in the corner regions is less than in the straight wall sections, and wherein the wall thickness increases towards the center of the straight wall sections.

The invention further relates to an assembly comprising an air duct according to any one of the preceding claims and a functional element mounted in the air duct.

The functional element can have two snap-in legs which engage behind the undercut latching sections to fasten the functional element in the air duct. To mount the functional element, it can be pushed onto the fastening means open to the end faces via one of the end faces of the air duct. The snap-in legs can be connected to each other via two latching or snap-in legs connecting them. When the snap-in legs are installed in the latching sections, the snap-in legs can be slightly pretensioned. This ensures secure fastening of the functional element in the air duct.

It may further be provided that the functional element comprises an air duct supporting member extending between the fastener and the duct wall section opposite the fastener. It may be provided that the support element slightly biases the opposing supported duct walls toward each other. If the air duct has two opposite fastening means, the support element can be inserted into the respective fastening means accordingly with opposite snap-in legs. If only one fastening means is provided in the flat duct, the support element can be designed in such a way that it has a force introduction surface on its side opposite the fastening means. The force introduction surface can be designed in particular parallel to the duct wall adjacent thereto, so that the force introduction surface lies flat against the duct wall associated therewith. The provision of a force introduction surface results in improved support or anti-tilt protection of the support element, whereby the support element is supported in accordance with the third Euler buckling case and thus has a higher critical buckling load. Further, the support element may be formed as a support web having a web portion extending substantially parallel to the height extent of the duct. The web section can have a thickening towards the center of the web. This is where the highest stresses can occur. The web center can have a thickness of 1.9-2.1 mm, preferably 1.95-2.05, particularly preferably 1.99 mm.

In addition, the functional element can have a cover extending between the undercut latching sections, by means of which a cable duct is formed between the cover and the duct wall section covered by it, separated from the flow area and extending in the longitudinal direction of the duct. The cable duct can be designed in such a way that, for example, a compressed air hose of 8 mm diameter and a 4×6 mm cable can be accommodated in it simultaneously. The cover can extend between and/or be formed onto the two snap-in legs. In particular, the cover may be semi-circular in shape. Furthermore, the cover and the support web can be designed as a combination. In this case, the support web above the cover can extend away from the latter. The support web can be integrally formed with the cover. The semicircular design of the cover in combination with the support element provides particularly good stress distribution. Immediately above the cover, the web can have a thickness of between 1.2-1.4 mm, preferably 1.25-1.35 mm, particularly preferably 1.28 mm. Immediately below the force introduction surface, the web can have a thickness between 1.15-1.35 mm, preferably 1.2-1.3 mm, particularly preferably 1.23 mm.

The surfaces of the functional elements assigned to the flow areas of the air duct can each be covered with a riblet structure.

BRIEF DESCRIPTION OF THE DRAWINGS

Further features, advantages and characteristics of the invention can be seen in the following description of preferred embodiments of the invention with reference to the accompanying drawings, in which shows.

DESCRIPTION OF THE PREFERRED EMBODIMENTS

Figure 1:
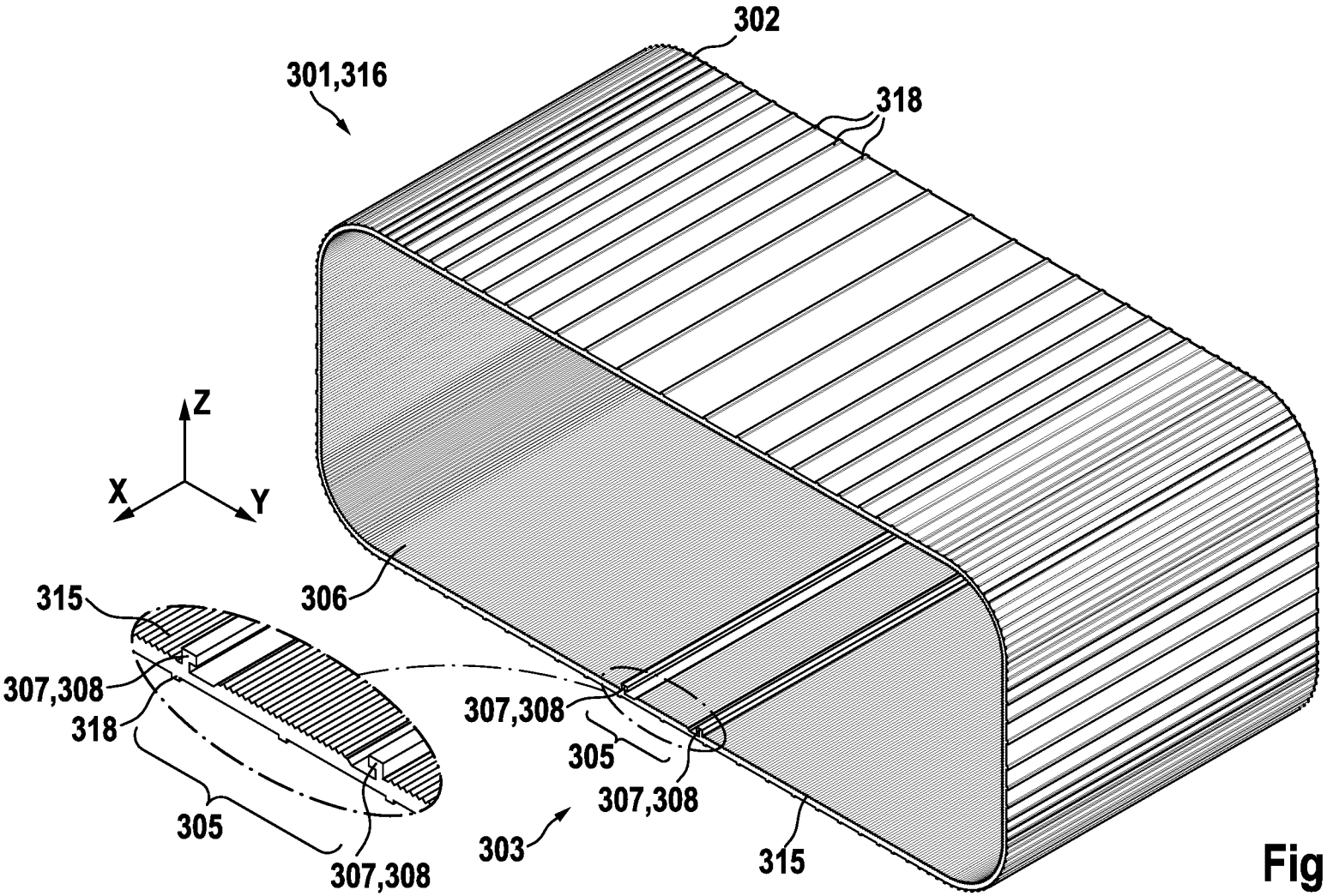
FIG. 1 is a perspective view of an embodiment of a flat duct according to the invention.

FIG. 1 shows a first embodiment of the air duct 301 in the form of a flat duct 316, which extends substantially in a longitudinal direction X, which corresponds to the direction of flow, in a transverse direction Y and in a vertical direction Z, the horizontal wall sections aligned in the transverse direction Y being longer than the vertical wall sections aligned in the vertical direction Z. The four wall sections shown together form the duct wall 302 enclosing the flow cross-section lying in the Y-Z plane, the corner regions of the adjacent duct wall sections each being rounded. The four wall sections shown together form the duct wall 302 enclosing the flow cross-section lying in the Y-Z plane, wherein the corner regions of the adjacent duct wall sections are each rounded. Centered in the duct interior 306 on the lower horizontal duct wall, a fastening means 303 is arranged in the duct wall section 305, which has two parallel linear rails 307 with latching sections 308 pointing towards one another, the latching sections 308 being of undercut design with respect to the duct interior 306. The parallel linear rails 307 thereby extend in the longitudinal direction X of the flat duct 316. It can be seen that a rib structure 315, so-called riblets, covering the walls is arranged on the duct wall 302 in the duct interior 306, the ribs extending in the longitudinal direction X of the flat duct 316. The fine riblets 315 impede transverse movements of the vortices in the turbulent flow prevailing in the flat duct, thereby minimizing frictional losses at the walls. It can further be seen that stiffening ribs 318 are arranged on the outer sides of the duct walls 302 in the longitudinal direction X of the duct 301, thereby increasing the torsional stiffness of the duct. As can be seen, the stiffening ribs 318 have a smaller spacing in the corner regions of the duct 301 than on the straight wall sections, with the spacing of the stiffening ribs 318 further decreasing towards the center of the straight wall sections.

Figure 2:
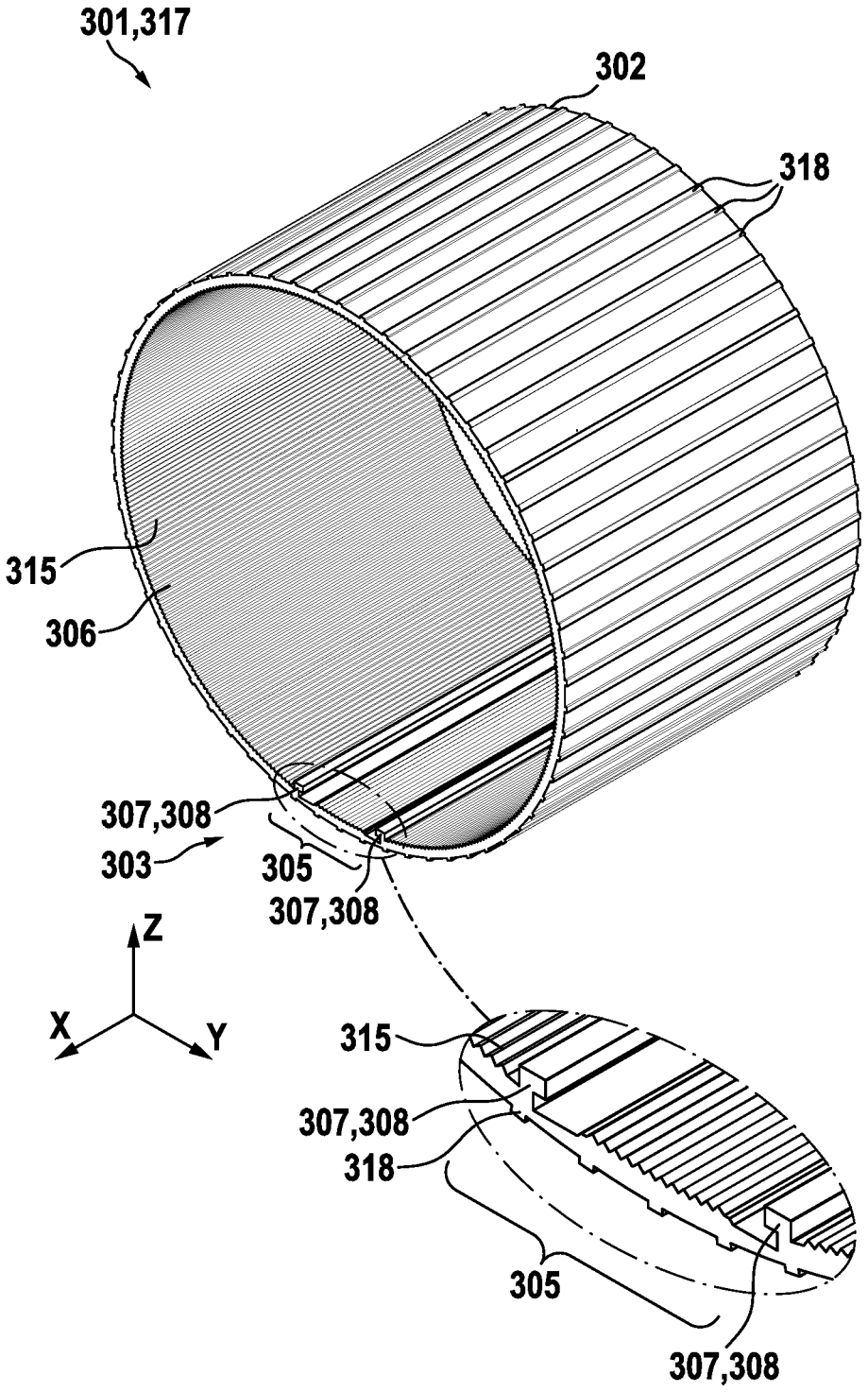
FIG. 2 is a perspective view of an embodiment of a round duct according to the invention.

FIG. 2 shows a second embodiment of the air duct 301 in the form of a round duct 317. The duct wall 302 enclosing the round flow cross-section has on its inner side on a duct wall section 305 a fastening means 303 which, like the embodiment shown in FIG. 1, has two parallel linear rails 307 which have riblets facing each other. The inside of the round duct 317 is also lined with riblets 315.

Figure 3A:
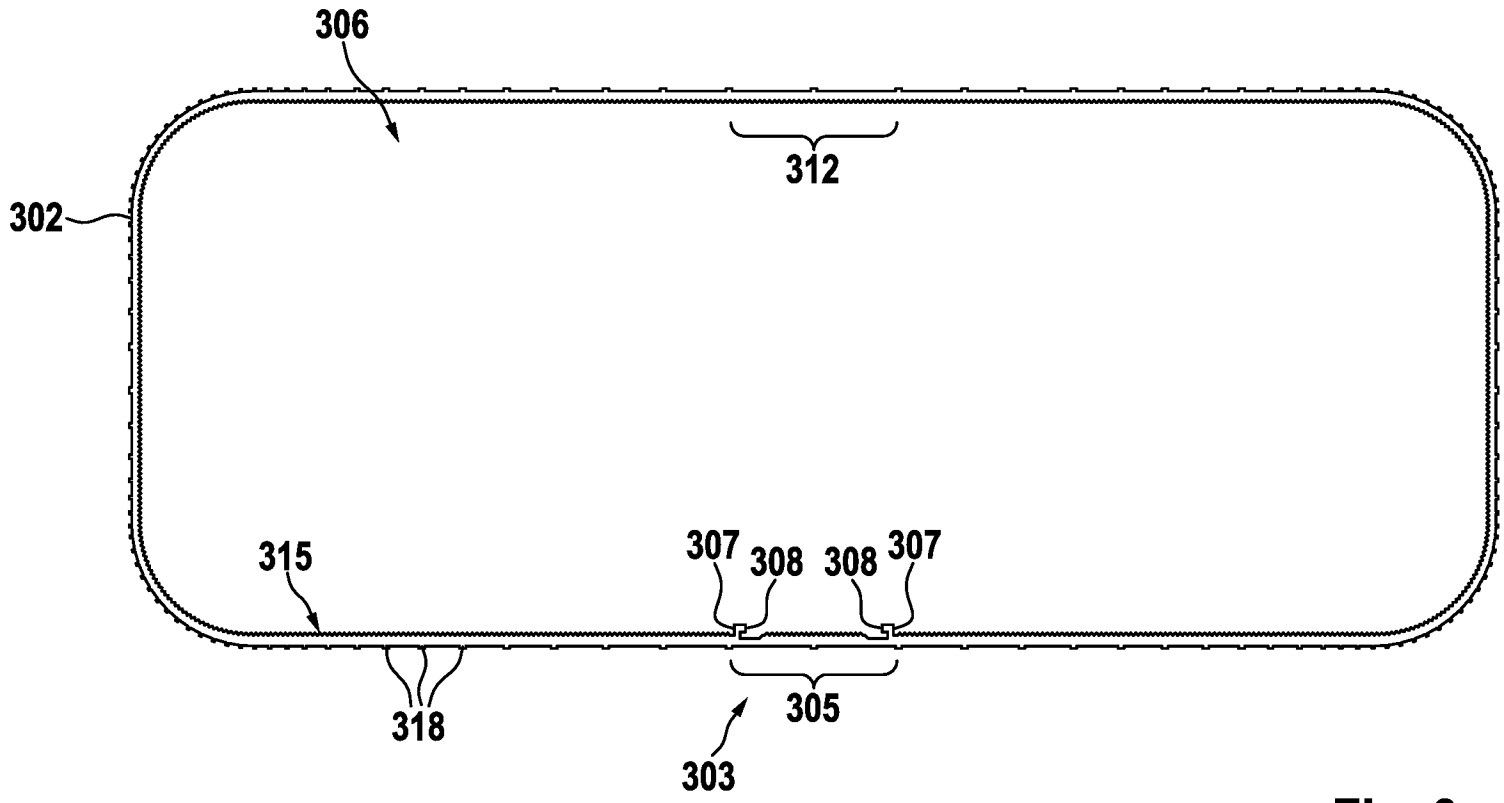
FIG. 3*a* is a cross-sectional view of an embodiment of a flat duct according to the invention with a fastening means.
Figure 3B:
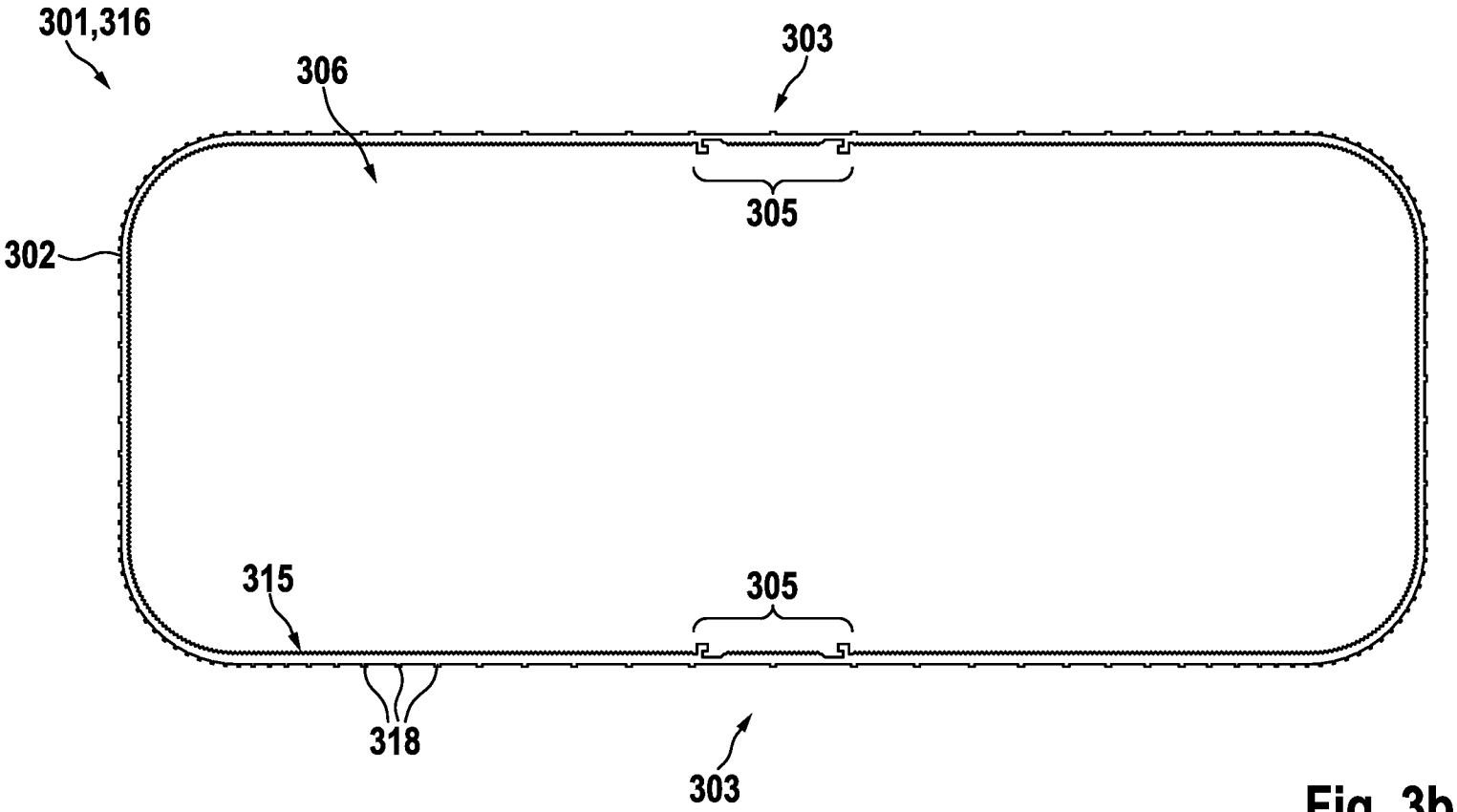
FIG. 3*b* is a cross-sectional view of an embodiment of a flat duct according to the invention with two opposing fastening means.

FIGS. 3*a* and 3*b* each show cross-sectional views of a flat duct 316, with the embodiment shown in FIG. 3*a* having one fastener 303 and the embodiment shown in FIG. 3*b* having two opposing fasteners 303. As can be seen, the flat duct 316 has a varying wall thickness, with the wall thickness being less in the corner portions than in the straight wall portions, with the wall thickness increasing towards the center of the straight wall portions. As a result, the outside of the straight wall sections has a slight slope toward the center thereof. It can be seen that riblets 315 extending in longitudinal direction X are arranged distributed over the entire flow cross-section in the duct interior 306. Furthermore, stiffening ribs 318 extending in longitudinal direction X are arranged on the outside of the wall 302 of the duct 316. The fastening means 303 disposed at the bottom of the flat duct 316 includes two opposing linear rails 307, each linear rail 307 having a latching section 308 aligned parallel to the bottom wall section, the two latching sections 308 of the parallel linear rails 307 facing each other. The latching sections 308 are each connected to the lower duct wall section by a substantially vertically disposed first section spaced therefrom. Below the latching sections 308, the linear rails 307 have guide grooves introduced in the wall section associated therewith in the longitudinal direction X, which serve as an additional linear guide for the respective inserted functional element. Between the linear rails 307, the duct wall also has riblets 315 on its inner side, in case the air duct is used without a functional element and the relevant surface is exposed. In FIG. 3*b*, it can be seen that the wall sections 305 of the fastening means 303, which are of the same shape and are opposite each other in the height direction Z, are aligned with each other in the transverse direction Y.

Figure 4A:
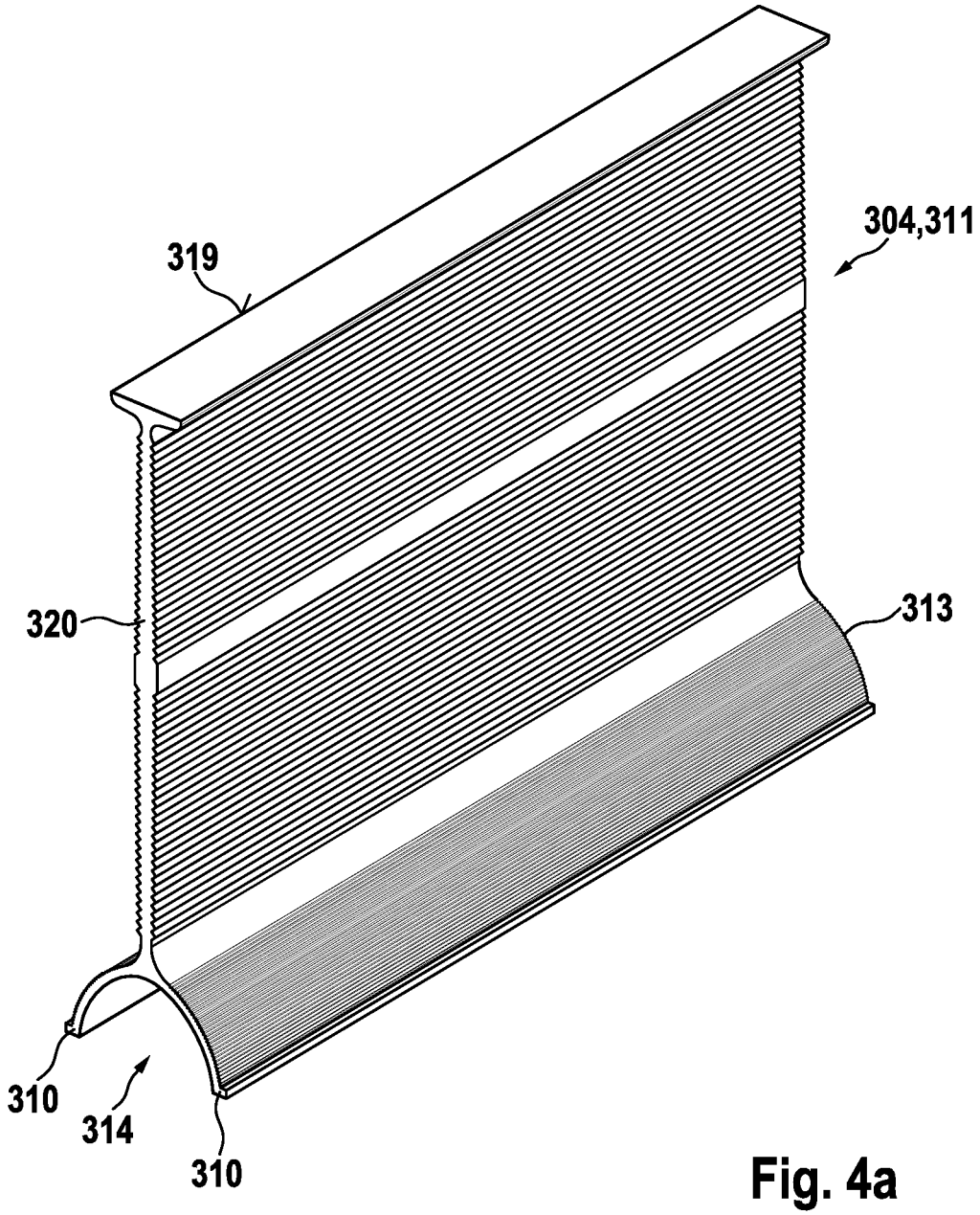
FIG. 4*a* is a perspective view of a support web cable duct combination according to the invention.
Figure 4B:
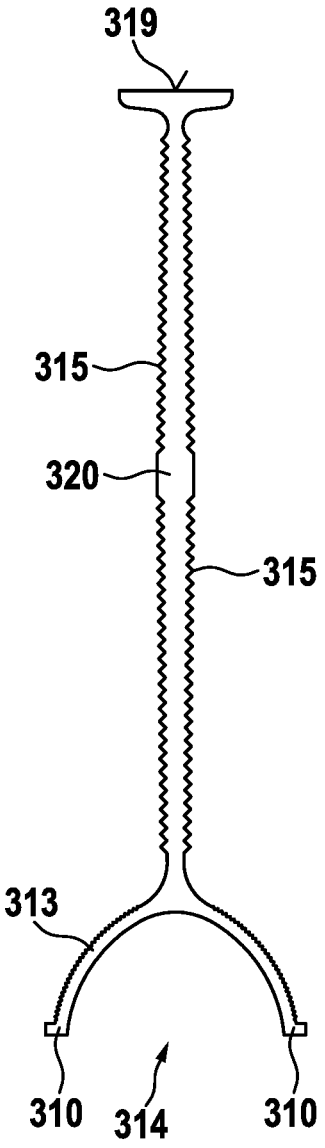
FIG. 4*b* is a cross-sectional view of a support web cable duct combination according to the invention.

FIG. 4 shows a functional element 304 which can be mounted in the air duct 301 and is in the form of a combination of a support element 311 and a cover 313. For fastening the functional element 304, this has snap-in legs 310 which can be inserted into the latching sections 308 of the fastening means 303 and engage behind these in each case. As a result, the functional element is displaceable in the longitudinal direction X of the air duct 301 and is restricted in all other degrees of freedom. The snap-in legs 310 are connected to the support section 320 of the support element 311 via snap-in legs, wherein the snap-in legs are designed to be curved in a semicircular shape so that a separate cavity is formed thereunder, which is separated from the flow cross-section and can be used as a cable duct 314. As can be seen in FIG. 4*b*, the thickness of the support section 320 increases towards the center and is smaller in comparison in the region of the connection points to the snap-in legs or the cover 313 and to the force introduction surface 319 on the upper side of the support element. The force introduction surface 319 joins the upper end of the support section 320 in a T-shape and protrudes laterally. The outer surfaces of the functional element 304, that is, the surfaces facing the flow duct, are covered with riblets 315.

Figure 5A:
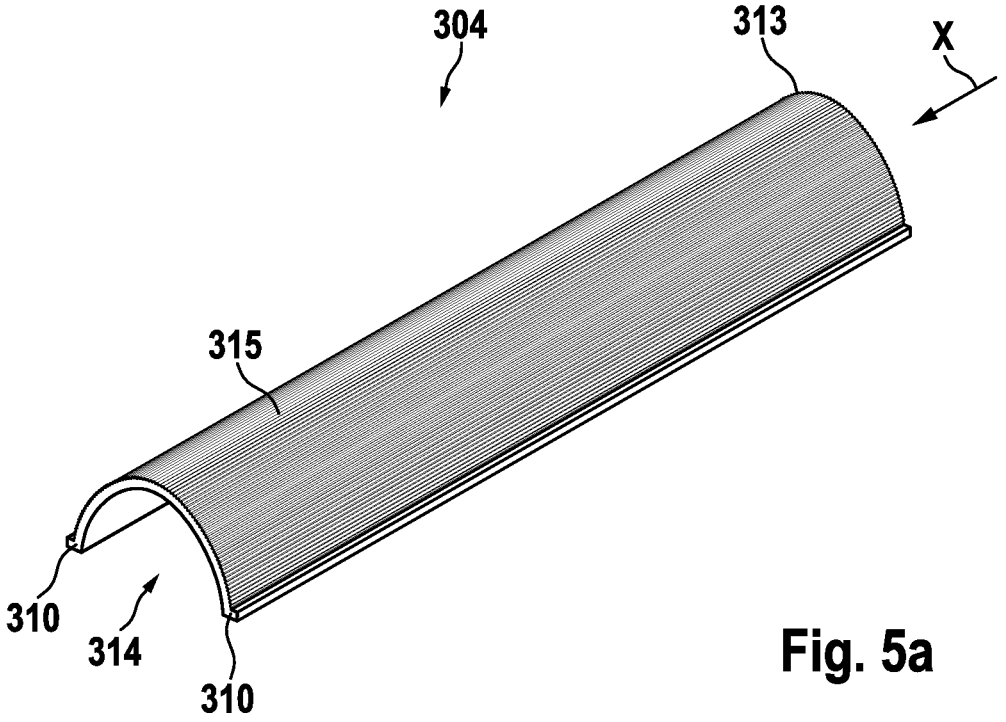
FIG. 5*a* is a perspective view of a cable duct.
Figure 5B:
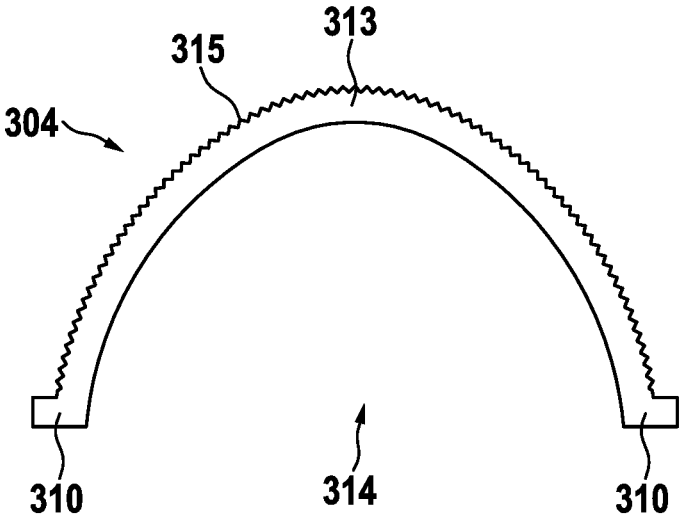
FIG. 5*b* is a cross-sectional view of a cable duct.

In FIG. 5*a*, the functional element 304 is shown as a cover 313 in perspective, in FIG. 5*b* as a cross-sectional view. Under the cover, when inserted into the air duct 301, a cable duct 314 extending in the longitudinal direction X is formed. As can be seen, the cover has a semicircular, dome-like contour, although other cross-sections are conceivable. At the lower ends of the semicircle or the snap-in legs, the snap-in legs 310 extend horizontally and in mutually opposite directions away therefrom. The surface of the cover 313 is covered with riblets 315.

Figure 6:
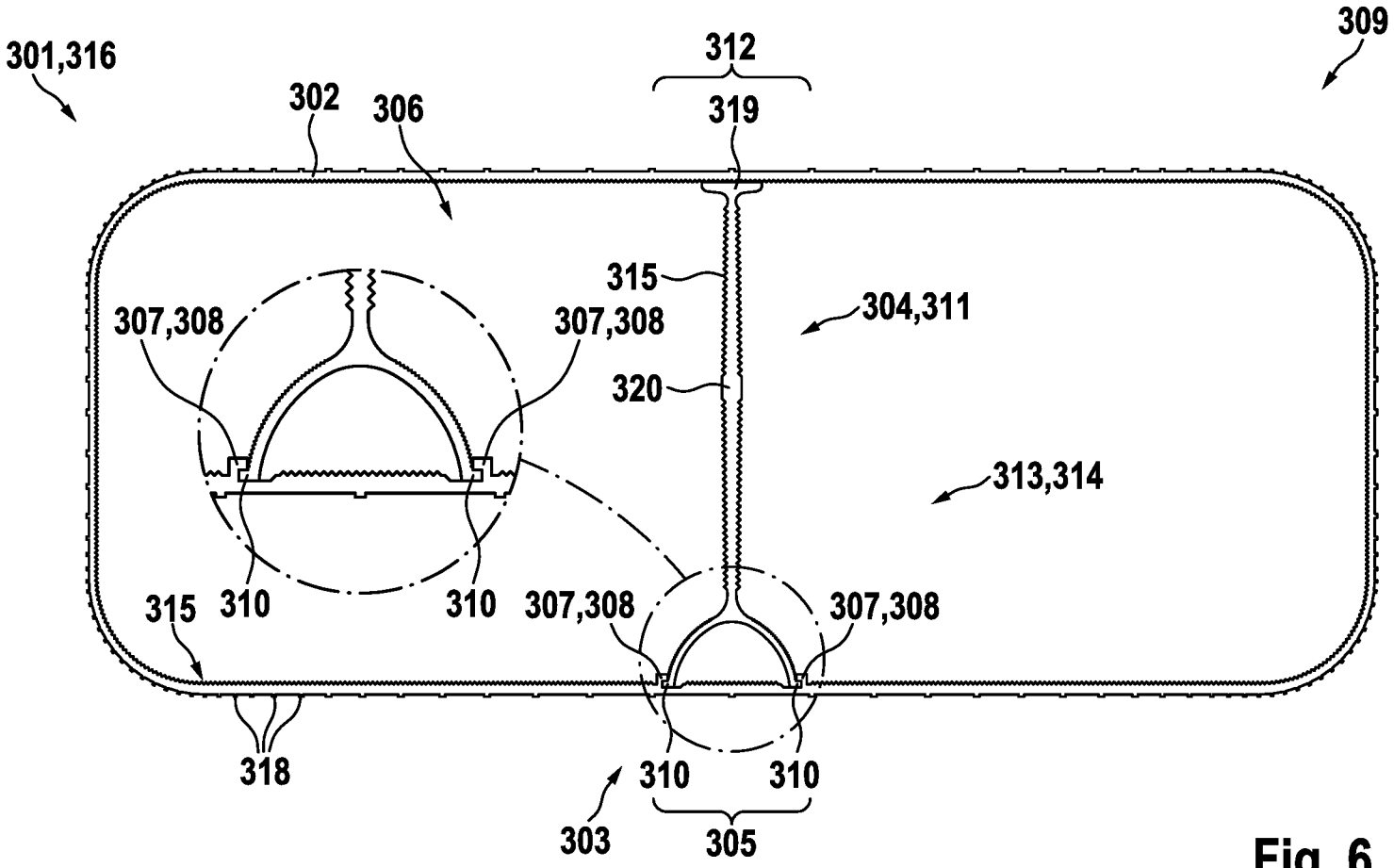
FIG. 6 is a cross-sectional view of a functional element inserted into a flat duct.

An assembly 309 of a flat duct 316 and a functional element 304 received therein is shown in FIG. 6. In this case, the accommodated functional element 304 is the support web and cable duct combination shown in FIG. 4, which serves on the one hand to support the flat duct in its height direction Z and on the other hand to provide a cable duct 314. For assembly, the functional element 304 is slid longitudinally into the flat duct 316 from one of its end faces, and the snap-in legs 310 of the functional element 304 are threaded into the latching sections 308 of the linear rails 307. In this process, the snap-in legs are compressed as they are inserted into the fastening means 303 under slight pretension for better fixation. It can be seen that the undersides of the snap-in legs are guided in the longitudinal grooves formed in the duct wall adjacent thereto. At the duct wall section 312 opposite the fastening means, the support element 311 supports the opposite duct wall by means of the force introduction surface 319 resting against the latter. Between the cover 313 and the duct wall section 305 covered by it and having the fastening means 303, a cable duct 314 is formed, which is fluidically separated from the flow duct of the air duct.

The features of the invention disclosed in the foregoing description, in the drawings as well as in the claims may be essential to the realization of the invention both individually and in any combination.

What is claimed is:

1. An air duct, which extends essentially in a longitudinal direction (X), comprising a duct wall which encloses a flow cross section and, on its inner side, has at least one fastening means for fastening at least one functional element, which is mounted in the air duct, in a variable position in the longitudinal direction (X) of the duct; wherein the fastening means has at least two undercut latching sections, wherein the functional element can be pushed onto the fastening means in the longitudinal direction (X) of the duct; and wherein the functional element includes two snap-in legs that engage behind the undercut latching sections to secure the functional element in the air duct.

2. The air duct according to claim 1, wherein the fastening means is configured to inhibit movement of the functional element from the duct wall section comprising the fastening means toward the duct interior.

3. The air duct according to claim 1, wherein the fastening means is configured to inhibit movement of the functional element in a transverse direction (Y) of the duct wall section comprising the fastening means.

4. The air duct according to claim 1, wherein the fastening means is configured to inhibit twisting of the functional element about an axis of rotation perpendicular to the plane of the duct wall section comprising the fastening means.

5. The air duct according to claim 1, wherein the fastening means is configured to prevent twisting of the functional element about an axis of rotation perpendicular to the flow cross-section.

6. The air duct according to claim 1, wherein the fastening means is configured to inhibit twisting of the functional element about an axis of rotation perpendicular to the longitudinal section of the duct.

7. The air duct according to claim 1, wherein the fastening means comprises at least one linear rail extending at least in sections in the longitudinal direction (X) of the duct.

8. The air duct of claim 7, wherein the fastening means comprises two parallel linear rails, each having an undercut latching section.

9. The air duct of claim 8, wherein the undercut latching sections face toward or away from each other.

10. The air duct according to claim 1, wherein the fastening means is integrally formed with or molded to the duct wall.

11. The air duct of claim 1, wherein the functional element comprises a support element supporting the air duct and extending between the fastening means and the duct wall section opposite the fastening means.

12. The air duct of claim 11, wherein the thickness of the support element increases towards the center of the duct and is smaller in contrast in the region of the duct walls.

13. The air duct of claim 1, wherein the functional element has a cover extending between the undercut latching sections, by means of which a cable duct is formed between the cover and the duct wall section covered by the latter, which cable duct is separated from the flow area and extends in the longitudinal direction (X) of the duct.

14. An air duct, which extends essentially in a longitudinal direction (X), comprising a duct wall which encloses a flow cross section and, on its inner side, has at least one fastening means for fastening at least one functional element, which can be accommodated in the air duct, in a variable position in the longitudinal direction (X) of the duct, and wherein the air duct is configured as a flat duct and has a varying wall thickness, wherein the wall thickness in the corner portions is less than in straight wall portions, and wherein the wall thickness increases towards the center of the straight wall portions.

* * * * *